United States Patent [19]

Bakermans

[11] 4,005,518

[45] Feb. 1, 1977

[54] APPARATUS FOR CONNECTING CONDUCTORS IN FLAT CABLE TO TERMINALS IN A CONNECTOR

[75] Inventor: Johannes Cornelis Wilhelmus Bakermans, Harrisburg, Pa.

[73] Assignee: AMP Incorporated, Harrisburg, Pa.

[22] Filed: Mar. 15, 1976

[21] Appl. No.: 666,552

[52] U.S. Cl. ..... 29/752; 29/759; 29/749; 29/628

[51] Int. Cl.[2] ..... H01R 43/04

[58] Field of Search ..... 29/203 C, 203 DT, 203 D, 29/203 MW, 203 J, 203 P, 203 H, 203 HC, 628

[56] References Cited

UNITED STATES PATENTS

| | | | |
|---|---|---|---|
| 3,938,246 | 2/1976 | Over et al. | 29/628 |
| 3,956,811 | 5/1976 | Munshower | 29/203 D |

*Primary Examiner*—Carl E. Hall
*Attorney, Agent, or Firm*—Frederick W. Raring; Robert W. Pitts; Jay L. Seitchik

[57] ABSTRACT

Apparatus for installing a multi-contact connector on a flat, multi-conductor cable comprises a connector supporting means for supporting the connector in a predetermined position and a cable supporting means in surrounding relationship to the connector supporting means. The cable supporting means has a cable supporting surface on which the cable is clamped, the supporting surface being located such that a cable clamped thereon will be adjacent to and directly above terminals extending from a connector supported on the connector supporting surface. Upon applying a force against the cable supporting means, the cable is moved downwardly relative to the connector and the terminals penetrate the cable and establish electrical contact with the conductors therein.

9 Claims, 10 Drawing Figures

APPARATUS FOR CONNECTING CONDUCTORS IN FLAT CABLE TO TERMINALS IN A CONNECTOR

BACKGROUND OF THE INVENTION

This invention relates to an apparatus for installing a multi-contact electrical connector on a flat conductor cable so that electrical contact terminals, which extend from one face of the connector, penetrate the insulation of the cable and establish electrical contact with the conductors therein. The invention is disclosed herein as a fixture for the cable and the connector, and the fixture is adapted to be removably mounted in a crimping apparatus such as the hand tool shown in my co-pending application Ser. No. 666,553 filed on even date herewith.

Flat electrical cables of the type comprising a plurality of spaced apart conductors contained in insulating material are now widely used in many segments of the electrical industry. Electrical connections to the conductors of the cable can be made by means of an electrical connector comprising a housing having a cable receiving face from which a number of electrical terminals extend, the number of terminals being equal to the number of conductors in the cable. When the cable is moved against the cable receiving face, the terminals penetrate the insulation of the cable and establish electrical contact with the conductors. Connectors of this type or class are shown, for example, in U.S. Pat. Nos. 3,189,863 and 3,820,055.

Under some circumstances, the cable and the connector can be pressed together by simply locating the cable in alignment with the terminals and assembling a cap piece to the housing so that the cap piece pushes the cable against the cable supporting surface, see U.S. Pat. No. 3,225,833. It is also desirable under some circumstances to use a suitable assembly tool for installing the connector of the cable and one form of arbor press device for carrying out this operation is disclosed in U.S. Pat. No. 3,820,055. The apparatus disclosed in that patent has proved to be satisfactory under many circumstances, particularly where the cable and the connector have a relatively low number of conductors and terminals, say about 10. However, it is now recognized that a more sophisticated apparatus is needed when a relatively high count conductor cable (e.g. 50 conductors) is being connected to a connector. The installation of a connector on a high count connector cable gives rise to alignment problems in that the conductors must be aligned with the terminals and other problems which are not significant when low count cables are being connected to connectors.

In accordance with the instant invention there is provided a fixture which has a connector supporting means for supporting the connector in a predetermined position and a cable supporting means which surrounds the connector supporting means. The two supporting means are assembled to each other and maintained in a normal position by springs such that a cable supported in the cable supporting means will have its conductors adjacent to the ends of terminals extending from a connector supported on the connector supporting means. The cable supporting means and connector supporting means are moved relatively towards each other when the installation process is being carried out so that the terminals more relatively through the cable and establish contact with the conductors therein. The structural features of the invention are such that different cable and connector sizes can be accommodated and the cable and the terminals in the connector will always be precisely aligned so that they will be properly assembled to each other.

It is accordingly an object of the invention to provide an improved apparatus for installing a multi-contact connector on a multi-conductor cable. A further object is to provide a cable installing apparatus in the form of a fixture which can be used in conjunction with a suitable hand tool or arbor press. A further object is to provide an apparatus which is relatively foolproof in the sense that proper installation of the connector on the cable does not require a high degree of operator skill. A further object is to provide a relatively simple apparatus which will accommodate cables and connectors of varying sizes.

These and other objects of the invention are achieved in a preferred embodiment thereof which is briefly described in the foregoing abstract, which is described in detail below, and which is shown in the accompanying drawing in which.

Figure 1:
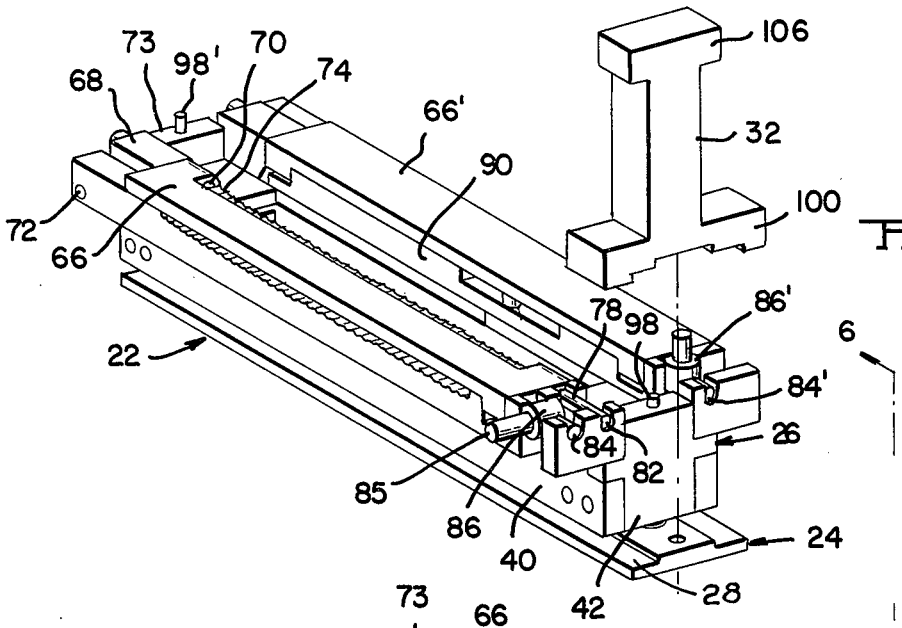
FIG. 1 is a perspective view of a preferred form of fixture in accordance with the invention.
Figure 4:
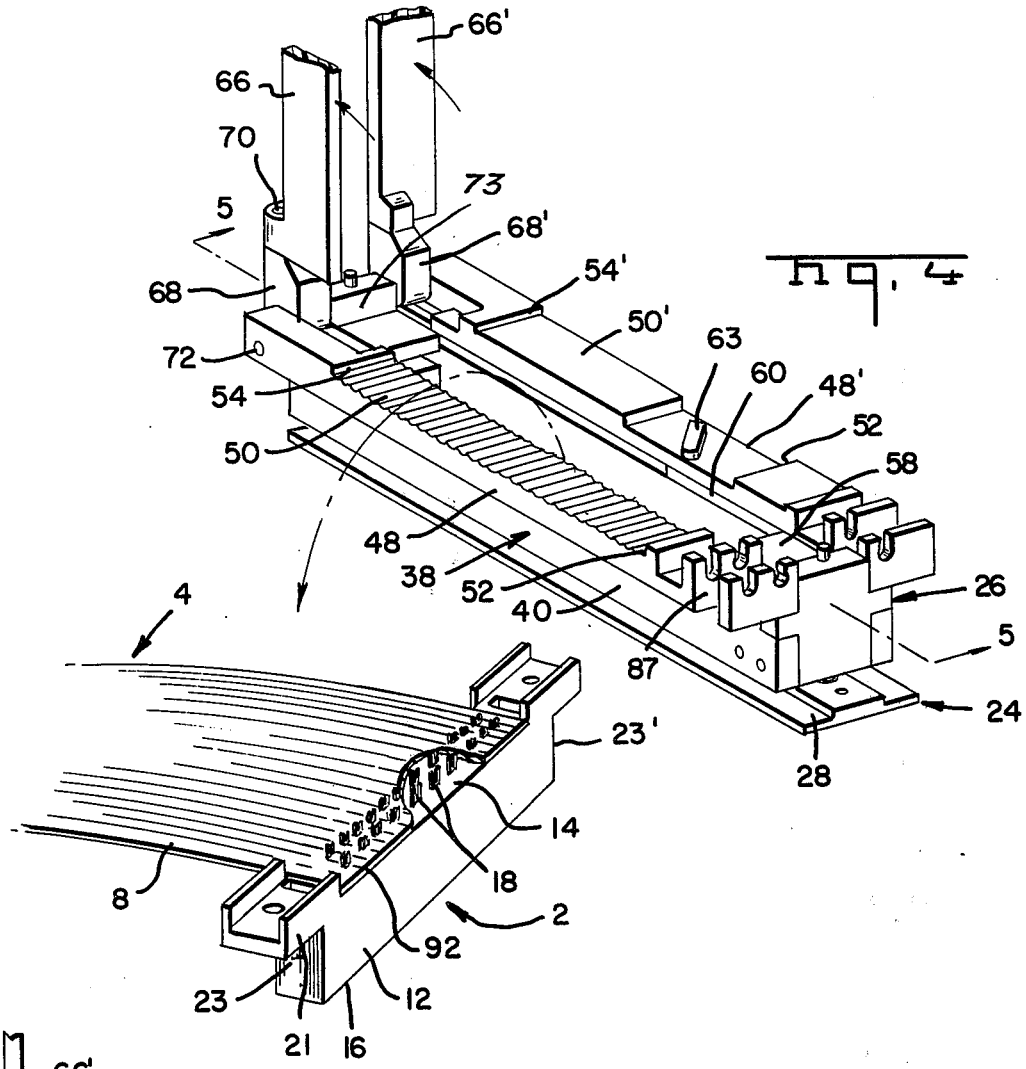
Figure 5:
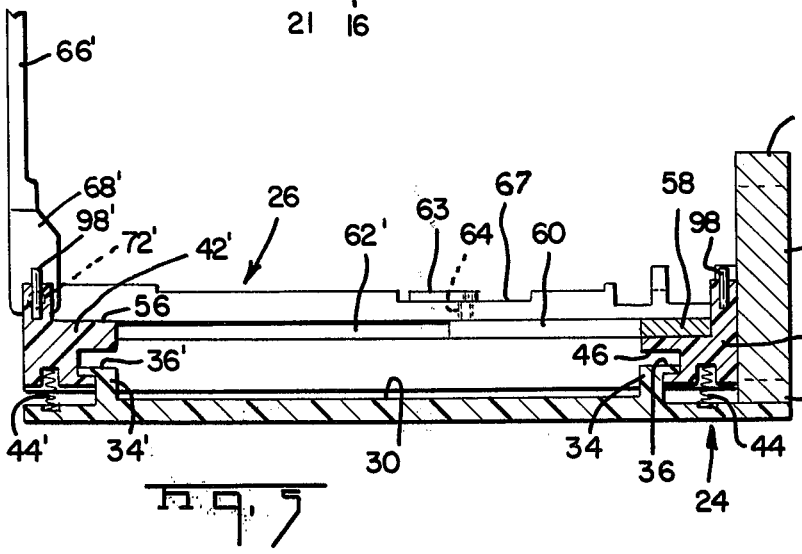
Figure 6:
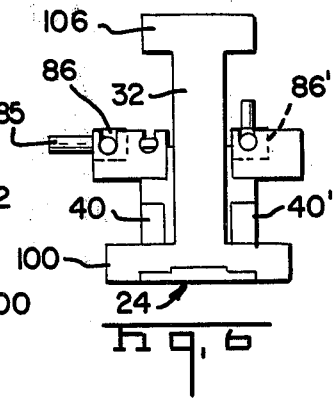

FIGS. 5 and 6 are views taken along the lines 5—5 and 6—6 of FIGS. 4 and 1 respectively.

Figure 7:
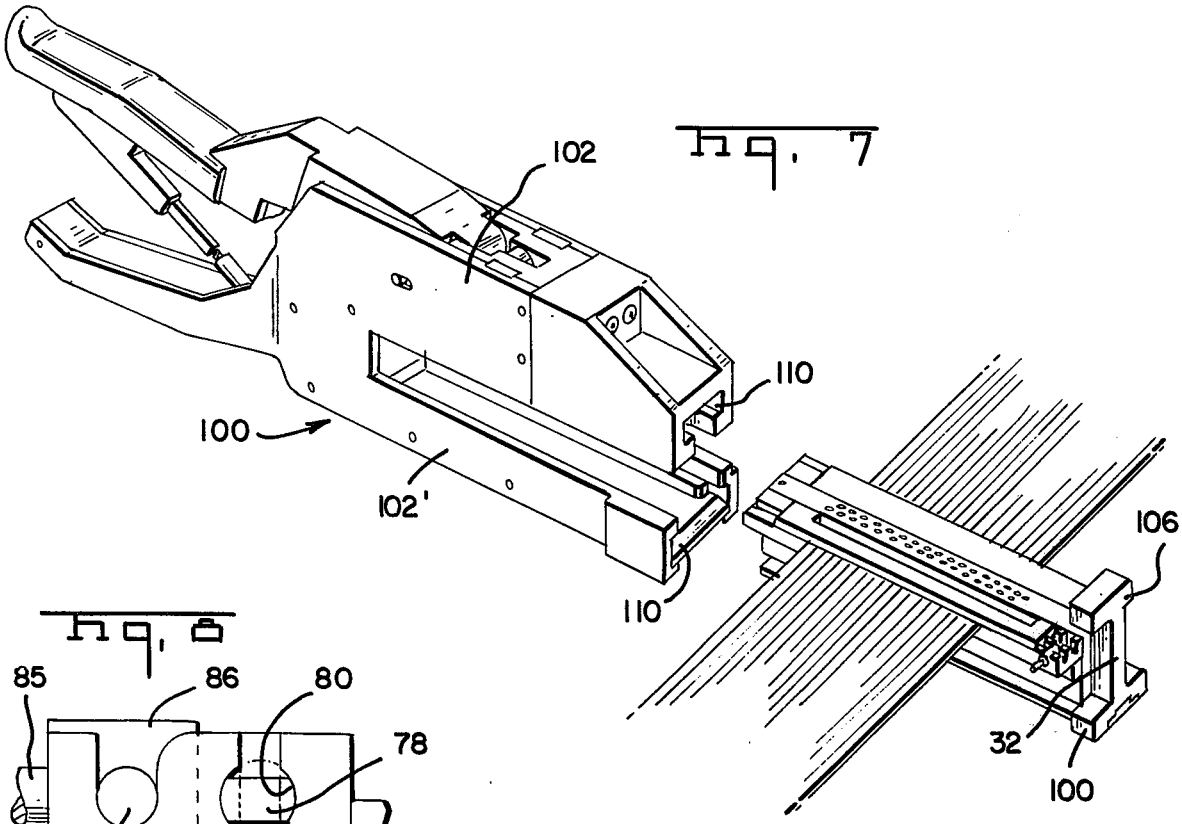

FIG. 7 is a perspective view of a hand tool which can be used in conjunction with a fixture in accordance with the invention.

Figure 8:
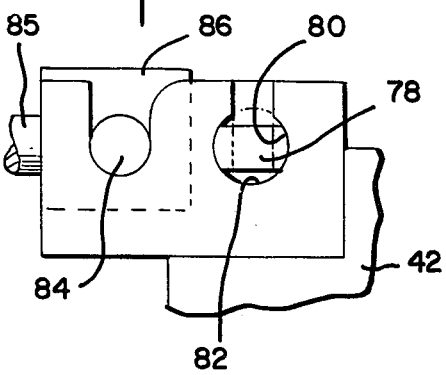

FIG. 8 is a fragmentary view showing details of a latching means for one of the clamping bars of the fixture.

Figure 9:
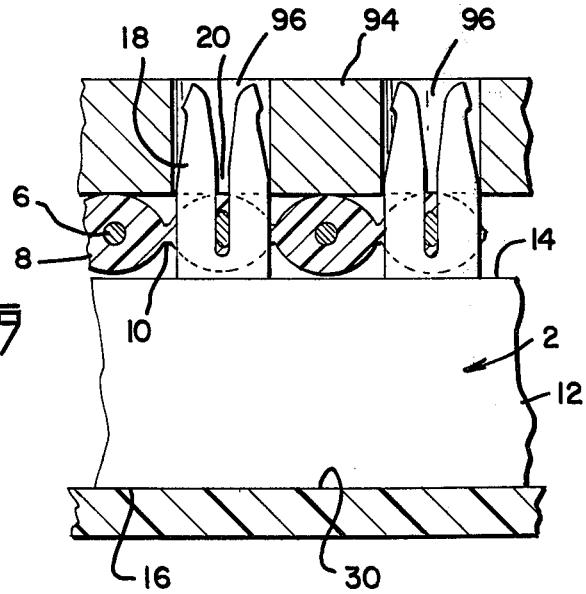

FIG. 9 is a fragmentary enlarged view showing the positions of the cable and terminals at the completion of the installing process.

Figure 10:
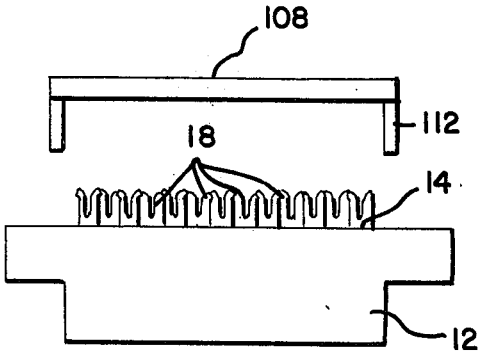

FIG. 10 is a side view of a multi-contact connector and a cover plate exploded from the connector.

The herein disclosed embodiment of the invention is adapted to install a connector 2 (FIG. 4) on a multi-conductor flat cable 4 having a plurality of spaced apart conductors 6 which are insulated as shown at 8. As shown in FIG. 9, recesses or grooves 10 are commonly provided between adjacent conductors and these recesses can serve to locate the cable in the fixture as will be explained below.

The connector 2 comprises a generally prismatic insulating housing 12 having a cable receiving face 14 and a face 16 on the opposite side thereof from the cable receiving face. A plurality of spaced apart terminals 18 extend from cable receiving face 14 on centers which correspond to the spacing between the conductors 6 in the cable. Each terminal 18 has wire receiving slot means as shown at 20 (FIG. 9) so that when the cable is forced downwardly over the upper free ends of the terminals, the terminals will penetrate the cable, and the conductors 6 will move relatively into the slots 20 and establish electrical contact therewith. The completed connector cable assembly includes a cover plate 108 which extends over the housing and is latched thereto by latch arms 112. Cover plate 108 has openings for the terminals.

It will be understood that the terminals may be of the general type disclosed in the above-identified U.S. Pat. No. 3,820,055 and each terminal may have a disengageable contact portion (not shown) located in the housing. The particular connector 2 shown herein is adapted to be disengageably mounted on the edge of a printed circuit board which would be inserted into a trough extending inwardly from the face 16 of the housing. It will be noted that the connector has ears 21 for mounting purposes which extend from its end walls 23, 23'.

A preferred form of fixture 22 in accordance with the invention comprises a connector supporting means 24 and a cable supporting means 26. The connector supporting means has a base plate 28 which is provided with an elongated surface 30 (FIG. 5) upon which the face 16 of the connector is supported. Locating bosses or blocks 34, 34' project upwardly at the ends of the surface 30 and these locating blocks have laterally extending ears 36, 36' which extend into portions of the cable supporting means 26 are described below.

The cable supporting means comprises a generally rectangular frame 38 having parallel side rails 40, 40' connected to each other by end blocks 42, 42'. The opposed surfaces of the blocks 42, 42' are recessed as shown at 46, (FIG. 5) and the ears 36, 36' extend into these recesses so that the parts are retained in assembled relationship. Limited movement of the frame member 38 toward the connector support surface 30 is permitted by virtue of the fact that the recesses 46 are oversized relative to the thickness of the ears 36. The cable clamping means 26 is normally biased upwardly to the limit of its travel by springs 44, 44' which extend into recesses in the opposed surfaces of the blocks 42, 42' and the surface of the base plate member 28.

Side rails 40, 40' have laterally outwardly extending flanges 48, 48' on their upper ends, the upper surfaces 50, 50' of these flanges constituting cable supporting surfaces when the connector is installed on a cable intermediate the ends thereof. Only the surface 50 is used as a cable supporting surface when the connector is installed on the end of the cable 4 as will be explained below.

The cable supporting surface 50 on the flange 48 has parallel shallow grooves therein which are dimensioned to receive the cable, the spacing between the deepest portions of grooves being the same as the spacing between adjacent conductors in the cable. Opposed shoulders 52, 54 are provided at the ends of the support surface 50 and the side edges of the cable can be located against these shoulders when the cable has a width which is the same as the width of the support surface 50. When a connector is being installed on a cable which is more narrow than the cable shown in the drawing, one edge of the cable is positioned against shoulder 52 and the cable is otherwise properly aligned by the grooves in the surface 50.

The end block 42' has an upwardly facing surface 56 (FIG. 5) which supports one of the flanges 21 of the connector housing. The other flange is supported on the upper surface of a transversely extending support plate 58 which extends across the gap between the side rails 40, 40'. Support plate 58 is L-shaped having an arm portion 60 which is received in a channel 62' in the side rail 40', the side edge of the plate portion 58 being received in a corresponding channel in the side rail 40. The supporting plate 58 and its integral arm portion 60 can thus be moved leftwardly as viewed in FIG. 5 towards the end block 42' so that a smaller size connector can be accommodated in the fixture and its flanges 21 will be supported on the surface 56 and the surface of support plate 58. Advantageously, a locking pin 64 is provided to lock this support member 58 in any desired position. This locking pin 64 is threaded through an opening in the side rail 40' and has a lever 63 on its upper end which is disposed in a recess 67 in the cable supporting surface 50'. The lever 63 is thus swung in one direction to unclamp the arm 60 and, after the plate has been moved to its desired position, lever 63 is swung in the opposite direction to clamp the plate.

The cable is clamped by clamping bars 66, 66' which differ from each other in certain respects. The clamping bar 66 is used when a connector is being installed on the end of a cable and will be described first.

Clamping bar 66 is pivotaly mounted on two pivotal axes, one of which extends through the lefthand end of clamping bar 66 and through a pivot block 68 which is disposed on the left hand end as viewed in FIG. 4 of the side rail 40. This pivotal axis is defined by a pivot pin 70 which extends through the end of the clamping bar and the block 68, the axis of this pin being parallel to the length of the clamping bar. At its other end, a pivot pin 78 (FIG. 8) extends from the clamping bar 66 and is received in a notch 82 in an enlarged end portion of the side plate 42. It will be noted that clamping bar 66 is notched or cut away as shown at 74 along its side edge which extends beside the opening in the fixture which receives the connector, the width of this cut away portion being slightly greater than the width of the cable.

Figure 2:
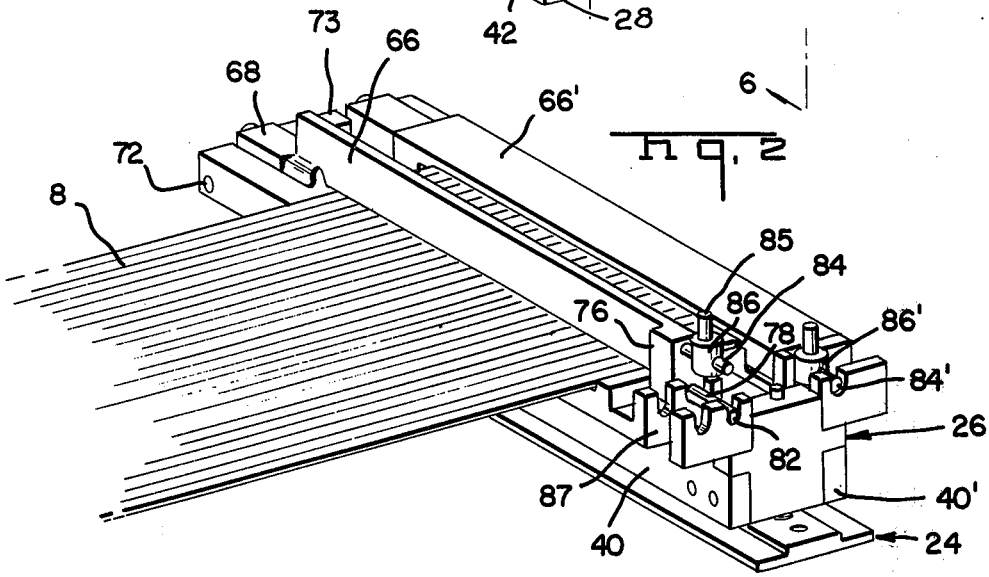
FIG. 2–4 are a series of views which illustrate the sequence of steps followed when a connector is installed on the end of a cable.
Figure 3:
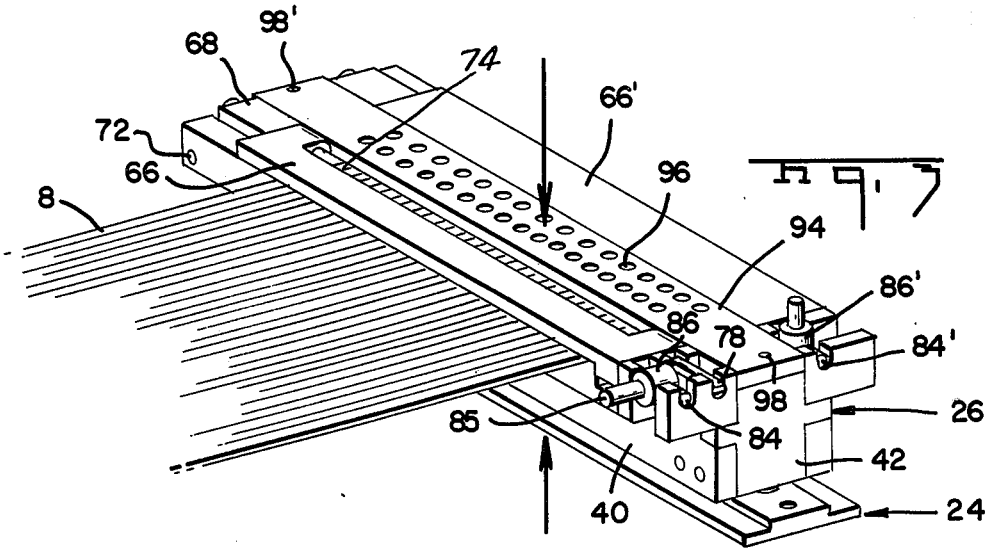

This first pivotal axis for the clamping bar 66 permits it to be rotated between the position shown in FIGS. 1 and 2. When it is in the position of FIG. 2, there is sufficient clearance to insert the cable into the notch 74 until its cut end 92 is against a stop surfaace 90. Thereafter, the clamping bar can be swung in the reverse direction to the position shown in FIG. 3 and the cable will be firmly clamped against the surface 50.

The pivot block 68 is pivotally connected to the end block 42' by a pivot pin 72 which extends through the flange 48, through the block 68, and into an upper central portion 73 of the end block 42'. By virtue of this pivotal mounting of clamping bar 66, it can be swung upwardly from the position of FIG. 3 to the position of FIG. 4 so that the cable, having a connector installed thereon, can be removed from the fixture.

The previously identified pivot pin 78 (FIG. 8) has flats ground on diametrically opposite sides and the slot or notch 80 is preferably a key hole-type slot having a constricited entrance so that the pin can enter the notch and can be rotated after it has fully entered the notch to permit shifting of the clamping bar between the positions of FIGS. 1 and 2.

It is desirable to provide means to latch the clamping bar in the position of FIG. 1, that is in clamping engagement with the cable. To this end, an additional pivot pin 84 extends from the free end of the clamping bar 66 and a laterally extending handle pin 85 extends from the pivot pin. A cylindrical latching bushing 86 is provided on pin 85 and this latching bushing has a snug fit in a recess 87 in the righthand end of the flange 48.

It will thus be apparent that it is merely necessary to grasp the pin 85 when the parts are in the position of FIG. 1 and swung upwardly to permit insertion of the cable into the clearance between surface 50 and clamping bar 66. Pin 85 is then swung downwardly to clamp the cable and after the connector has been connected to the cable, pin 85 is again swung upwardly and the entire latch arm 66 is moved arcuately about its pivotal axis 72 away from the cable to permit removal of the connector (FIG. 4).

After the cable has been clamped in the fixture, a rectangular pressure plate 94 is located in the space between the adjacent edges of the clamping members 66, 66' on pins 98, 98' which extend from the end blocks 42, 42'. Pressure plate 94 has openings 96 extending therethrough to provide clearance for the upper ends of the terminals so that application of a force in the direction of the arrow of FIG. 3 results in downward movement of a pressure plate and the cable clamping means with respect to the connector on the connector supporting surface.

It will be apparent from the foregoing that the procedure for installing a connector 2 on the end of a cable 4 is as follows: the clamping bar 66 is rotated about the axis defined by the pins 70, 78 until it is in the position of FIG. 2 and the cable is inserted through the notch 74 in the clamping bar until its cut end is against the stop surface 90. Clamping bar 66 is then rotated back to the position of FIG. 3 to clamp the cable in the fixture. The pressure plate 94 is then positioned in the fixture on the pins 98, 98' and the fixture is placed in a suitable tool or arbor press. Pressure is applied against the pressure plate 94 and against central portions of the bars 66, 66' so that the entire cable supporting means 26 is moved downwardly relative to the connector which is on the surface 30. After the conductors have been connected to the terminal, the pressure plate is removed and the cover plate 108 is positioned in the fixture in the opening between the arms 66, 66'. The ram of the press or hand tool is then, again, moved against the fixture and the cover plate is moved towards the housing and latched by arms 112 to the housing.

Under some circumstances, it may prove feasible to use the cover plate 108 as a pressure plate. If this procedure is followed, the cover plate, rather than the pressure plate 94, is positioned in the fixture prior to the step of applying pressure on the fixture to move the cable towards the connector. When this procedure is followed, the cable conductors are connected to the terminals and the cover plate is assembled to the housing in a single step.

The clamp arm 66' remains in its lowered or closed position (FIGS. 1–4) when a connector is being installed on the end of a cable and the surface 90 of the flange 50' and the edge of clamping arm 66' serve as a stop for the end 92 of the cable. Clamping bar 66' is used only when the connector is installed on the intermediate portion of the cable as shown in FIG. 7.

Clamping bar 66' is of more simple construction than clamping bar 66 in that block 68' is rigidly secured to, or is integral with, the clamping bar 66'. A fixed latching bushing 86' is provided on the end of clamping bar 66' but it is not necessary that this bushing be pivotally mounted as is the bushing 84. This pin 84' is thus fixed to the end of clamping arm 66'.

When it is desired to install a connector on an intermediate portion of the cable, both of the clamping bars 66, 66' are swung upwardly and the intermediate portion of the cable is positioned on the surfaces 50, 50' so that it extends across the connector 2 which is supported on the connector supporting surface. Thereafter, the clamping bars are swung downwardly, the cable is clamped by both clamping bars, the pressure plate 94 is positioned in the fixture on the pins 98, and a compressing force is applied against the pressure plate and, preferably, adjacent upper surface portions of the clamping bars. The cable supporting means 26 is thereby moved relatively downwardly so that the upper ends of the terminals 18 pierce the cable as shown in FIG. 9 and the conductors move relatively into the slots 20.

The fixture 22 can be placed in a conventional arbor press having a ram to apply the force to the upper surface of the fixture or a suitable hand tool 100 (FIG. 7) can be used. This hand tool is described in my copending application Ser. No. 666,553 and need not be described in detail. The tool has upper and lower jaws 102, 102', the upper jaw having a ram which is actuated by a movable handle 103 for applying the compressive force to the fixture. The fixture is slidably received in the lower jaw so that the cable can be placed in the fixture on a convenient workbench. The fixture is then slid into the tool, and the handle squeezed to install the connector on the cable.

The previously mentioned tension member 32 which is mounted on the base plate 28 of the fixture has enlarged upper and lower ends 106 which are received in complementary recesses in the tool in order to prevent flexure of the tool during use.

What is claimed is:

1. Apparatus for installing a multi-contact connector on a flat multi-conductor cable of the type having a plurality of conductors in side-by-side spaced-apart relationship, said connector being of the type comprising an insulating housing having a cable-receiving face and another face which is on the opposite side of said housing from said cable-receiving face, a plurality of contact terminals in said housing, said terminals having conductor-receiving portions which extend from said cable-receiving face, said apparatus comprising:

connector supporting means having a connector supporting surface for supporting said connector on said other face thereof, cable supporting means having a cable supporting surface, said connector supporting means and said cable supporting means being assembled to each other with said connector supporting surface extending parallel to, and beside, said cable supporting surface, said surfaces being offset from each other by a distance such that the free ends of terminals extending from a connector supported on said connector supporting surface are proximate to the plane defined by said cable supporting surface, compressible resilient means interposed between said cable supporting means and said connector supporting means, clamping means for clamping said cable against said cable supporting means with a portion of said cable extending in said plane of said cable supporting surface past a connector supported on said connector supporting means and, removable pressure transmitting plate means disposed beside said cable supporting surface and in alignment with a connector supported on said connector supporting means, said pressure transmitting plate means having terminal-receiving openings extending therethrough which are in alignment with said terminals in said connector whereby, upon positioning a connector upon said connector supporting surface and clamping said cable against said cable supporting surface by said clamping means, positioning said pressure transmitting plate means beside said cable supporting surface and applying pressure against said pressure transmitting plate means, said cable will be moved relatively towards said cablereceiving face of said connector and said conductor-receiving portions of said terminals will penetrate said cable and extablish contact with said conductors, and upon removal of said pressure, and unclamping of said cable, said connector and cable can be removed from said apparatus.

2. Apparatus as set forth in claim 1, said cable supporting means having an additional cable supporting surface, said cable supporting surface and said additional cable supporting surface being co-planar, parallel, and spaced-apart and said connector supporting means being between said cable supporting surfaces.

3. Apparatus as set forth in claim 1, said clamping means comprising a clamping bar pivotally mounted on a first pivotal axis located at one end thereof on said cable supporting means, said first pivotal axis permitting arcuate movement of said clamping bar towards and away from said cable supporting surface, and latching means on the other end of said clamping bar and on said cable supporting means for latching said clamping bar to said cable supporting means.

4. Apparatus as set forth in claim 3, said clamping bar being pivotally movable about a second pivotal axis which extends along the length of said clamping bar when said clamping bar is in a latched condition on said cable supporting means, said clamping bar being effective to firmly clamp a cable on said cable supporting surface when in one position defined by said second pivotal axis and not being in firm clamping engagement with said cable when in another position defined by said second pivotal axis.

5. Apparatus as set forth in claim 1, said cable supporting means having an additional cable supporting surface, said cable supporting surface and said additional cable supporting surface being co-planar, parallel, and spaced-apart, said connector supporting surface being between said cable supporting surfaces, said clamping means being effective to clamp portions of a cable against both of said cable supporting surfaces whereby intermediate portions of a cable can be clamped in said fixture and said connector installed on said intermediate portions.

6. Apparatus as set forth in claim 1, said apparatus comprising a fixture having means thereon for positioning said fixture in a compressing apparatus.

7. Apparatus for installing a multi-contact electrical connector on a flat multi-conductor cable of the type having a plurality of conductors in side-by-side spaced-apart relationship, said connector being of the type comprising an insulating housing having a cable-receiving face and another face which is on the opposite side of said housing from said cable-receiving face, a plurality of contact terminals in said housing, said terminals having conductor-receiving portions which extend from said cable-receiving face, said apparatus comprising:

connector supporting means having a connector supporting surface for supporting said connector on said other face thereof, cable supporting means in surrounding relationship to said connector supporting surface, said cable supporting means having at least one cable supporting surface extending parallel to, and beside, said connector supporting surface along one side thereof said surfaces being offset from each other by a distance such that the free ends of terminals extending from a connector supported on said connector supporting surface are proximate to the plane defined by said cable supporting surface.

said cable supporting means having cable stop means extending along the other side of said connector supporting surface, said cable stop means being opposed to said cable supporting surface whereby the end of a cable can be located against said stop means and a portion of said cable will be supported on said cable supporting surface and will extend past the free ends of terminals extending from a connector supported on said connector supporting surface, removable pressure transmitting plate means disposed between said cable supporting surface and said cable stop means, said pressure transmitting plate means having terminal receiving openings extending therethrough which are in alignment with said terminals in said connector whereby, upon positioning a connector upon said connector supporting surface and locating a cable on said cable supporting surface and against said stop means, positioning said pressure transmitting plate means beside said cable supporting surface and applying pressure against said pressure transmitting plate means, said cable will be moved relatively towards said cablereceiving face of said connector and said conductor-receiving portions of said terminals will penetrate said cable and establish contact with said conductors.

8. Apparatus as set forth in claim 7 having compressible resilient means interposed between said cable supporting means and said connector supporting means.

9. Apparatus as set forth in claim 8 including clamping means for clamping said cable against said cable supporting surface,

* * * * *